US010121413B2

(12) United States Patent
Morita et al.

(10) Patent No.: US 10,121,413 B2
(45) Date of Patent: Nov. 6, 2018

(54) DISPLAY DEVICE AND DRIVING METHOD THEREOF

(71) Applicant: Japan Display Inc., Tokyo (JP)

(72) Inventors: Tetsuo Morita, Tokyo (JP); Hiroyuki Kimura, Tokyo (JP); Makoto Shibusawa, Tokyo (JP); Hiroshi Nakayama, Tokyo (JP); Hiroshi Tabatake, Tokyo (JP); Yutaka Umeda, Tokyo (JP)

(73) Assignee: Japan Display Inc., Tokyo (JP)

( * ) Notice: Subject to any disclaimer, the term of this patent is extended or adjusted under 35 U.S.C. 154(b) by 550 days.

(21) Appl. No.: 14/858,348

(22) Filed: Sep. 18, 2015

(65) Prior Publication Data

US 2016/0086543 A1 Mar. 24, 2016

(30) Foreign Application Priority Data

Sep. 18, 2014 (JP) ..... 2014-189782

(51) Int. Cl.
*G09G 3/3233* (2016.01)

(52) U.S. Cl.
CPC ... *G09G 3/3233* (2013.01); *G09G 2300/0861* (2013.01); *G09G 2310/0245* (2013.01); *G09G 2330/021* (2013.01); *G09G 2330/025* (2013.01); *G09G 2330/026* (2013.01)

(58) Field of Classification Search
None
See application file for complete search history.

(56) References Cited

U.S. PATENT DOCUMENTS

2007/0132674 A1* 6/2007 Tsuge ..... G09G 3/2014 345/77
2008/0024400 A1* 1/2008 Uchino ..... G09G 3/3233 345/77
2009/0153448 A1 6/2009 Tomida et al.

FOREIGN PATENT DOCUMENTS

JP 2009-145594 A 7/2009
JP 2014-145851 A 8/2014
KR 10-2014-0050549 A 4/2014

OTHER PUBLICATIONS

Korean Office Action dated Jul. 11, 2016 for corresponding Korean Patent Application No. 10-2015-0130542.

* cited by examiner

*Primary Examiner* — Aneeta Yodichkas
*Assistant Examiner* — Parul Gupta
(74) *Attorney, Agent, or Firm* — Typha IP LLC

(57) ABSTRACT

A flash phenomenon of OLEDs at the time of power source ON of a display device is suppressed. The OLED emits light when reference potentials $V_{SS}$ and $V_{DD}$ are applied from power source lines to the OLED's cathode and anode respectively. While the anode can be connected to one of the power source line via a driving TFT and a lighting switch, a reset potential $V_{RS}$ can be applied to the anode via a reset switch and the driving TFT. The lighting switch is turned OFF and the reset switch and the driving TFT are turned ON so that $V_{RS}$ is applied to the anode, before starting the application of the reference potentials to the power source lines. Following this state, the application of the reference potentials to the power source lines starts, and thus a normal operation of allowing the OLED to emit light starts.

5 Claims, 9 Drawing Sheets

(PRIOR ART)

DISPLAY DEVICE AND DRIVING METHOD THEREOF

CROSS-REFERENCE TO RELATED APPLICATION

The present application claims priority from Japanese application JP2014-189782 filed on Sep. 18, 2014, the content of which is hereby incorporated by reference into this application.

BACKGROUND OF THE INVENTION

1. Field of the Invention

The present invention relates to a display device and a driving method thereof using a self-light emitting element which emits light by voltage application.

2. Description of the Related Art

As an electro-optic element used in a self-light emitting display device, an organic electroluminescence (EL) element has been known. The organic electroluminescence element is generally referred to as an organic light emitting diode (OLED), and is one type of light emitting diode.

FIG. 9 is a schematic circuit diagram of a pixel circuit 2 which is arranged in a display unit of an organic EL display panel. Each pixel circuit 2 includes an OLED 4 which is a light emitting element, a thin film transistor (TFT), a capacitor, and the like. A driving TFT 6 which is a driving transistor, alighting switch 8, a reset switch 10, and a write switch 12 are able to be configured of an n-channel type TFT (an n type TFT). A cathode electrode of the OLED 4 is connected to a driving power source $V_{SS}$, and an anode electrode is connected to a source of the driving TFT 6. A drain of the driving TFT 6 is connected to a driving power source $V_{DD}$ through the lighting switch 8 or is connected to a reset power source $V_{RS}$ through the reset switch 10. A capacitor 14 which has a retentive capacitance is connected between a gate terminal and a source terminal of the driving TFT 6.

The capacitor 14 writes and retains a voltage according to a pixel value through a video signal line 16 and the write switch 12, and the driving TFT 6 controls a current from the driving power source $V_{DD}$ to the OLED 4 according to the voltage retained in the capacitor 14, and thus the light emission of the OLED 4 is controlled. Furthermore, the retention voltage of the capacitor 14 is reset to a predetermined voltage by supplying an initialization voltage to the video signal line 16 and by setting the driving TFT 6 and the reset switch 10 to be in an ON state.

Here, The supply of a reference potential from the driving power sources $V_{DD}$ and $V_{SS}$ to power source lines 18 and 20 starts at the time of main power source ON of the display device.

SUMMARY OF THE INVENTION

A potential difference which is sufficient for allowing the OLED 4 to emit light is rapidly applied between the power source line 18 and the power source line 20 due to the main power source ON of the display device, and thus the OLED 4 of each pixel unintentionally emits light at the time of the main power source ON, and a flash phenomenon occurs in which the brightness of the entire screen is instantaneously changed. In order to prevent such a phenomenon, in the conventional art, the lighting switch 8, the write switch 12, and the reset switch 10 are in an OFF state at the time of the main power source ON, and thus a current is prevented from flowing through the OLED 4. However, according to the operation described above, the potential of each of the terminals of the driving TFT 6 becomes inconstant at the time of the main power source ON, and an unconsidered potential difference may be generated due to coupling between the power source line 18 and an internal node, and thus the flash phenomenon is not sufficiently suppressed.

An object of the present invention is to provide a display device and a driving method thereof which are able to prevent or suppress a flash phenomenon at the time of power source ON of the display device.

(1) A display device according to an aspect of the present invention includes a light emitting element emitting light by applying a voltage between electrodes; a first power source line applied with a first reference potential which is supplied to one electrode of the light emitting element; a second power source line applied with a second reference potential which allows the light emitting element to emit light; a driving transistor controlling an amount of current between a first current terminal which is connected to the other electrode of the light emitting element and a second current terminal which is connected to the second power source line according to a control voltage signal; a first switching element switching connection and disconnection between the second power source line and the second current terminal; a second switching element switching the presence or absence of application of a reset potential to the second current terminal from a reset power source; and a control unit executing a power source ON sequence, in which the power source ON sequence controls the first switching element so as to block between the driving transistor and the second power source line, and controls the second switching element and the driving transistor so as to set a preset state in which the other electrode of the light emitting element is connected to the reset power source, before starting the application of each of the reference potentials to the first power source line and the second power source line, and starts the application of each of the reference potentials to the first power source line and the second power source line in the preset state, thereby setting a ready state in which a normal operation of allowing the light emitting element to emit light is able to be performed.

(2) A display device according to another aspect of the present invention includes a light emitting element disposed in each of a plurality of pixels which are arranged in a plurality of rows and emitting light by applying a voltage between electrodes; a first power source line applied with a first reference potential which is supplied to one electrode of the light emitting element; a second power source line applied with a second reference potential which allows the light emitting element to emit light; a driving transistor disposed in each of the pixels and controlling an amount of current between a first current terminal which is connected to the other electrode of the light emitting element of the pixel and a second current terminal which is connected to the second power source line according to a control voltage signal; at least one first switching element switching connection and disconnection between the second power source line and the second current terminal of a plurality of the driving transistors which are arranged in each of pixel rows; at least one second switching element switching the presence or absence of application of a reset potential from a reset power source to the second current terminal of a plurality of the driving transistors which are arranged in each of the pixel rows; and a control unit executing a power source ON sequence, in which the power source ON sequence controls the first switching element so as to block between the driving transistor and the second power source line, and controls the second switching element and the driving transistor so as to set a preset state in which the other electrode of the light emitting element is connected to the reset power source, before starting the application of each of the reference potentials to the first power source line and the second power source line, in each of the pixel rows, starts the application of each of the reference potentials to the first power source line and the second power source line in the preset state, and then sequentially controls the second switching element for each of the pixel rows in synchronization with a raster scan so as to stop the supply of the reset potential to the other electrode of the light emitting element, and performs an operation of allowing the light emitting element of the pixel row to emit light.

(3) A driving method according to still another aspect of the present invention is for a display device includes a light emitting element emitting light by applying a voltage between electrodes, a first power source line applied with a first reference potential which is supplied to one electrode of the light emitting element, a second power source line applied with a second reference potential which allows the light emitting element to emit light, a driving transistor controlling an amount of current between a first current terminal which is connected to the other electrode of the light emitting element and a second current terminal which is connected to the second power source line according to a control voltage signal, a first switching element switching connection and disconnection between the second power source line and the second current terminal, and a second switching element switching the presence or absence of application of a reset potential to the second current terminal from a reset power source. The driving method includes controlling the first switching element so as to block between the driving transistor and the second power source line, and controlling the second switching element and the driving transistor so as to set a preset state in which the other electrode of the light emitting element is connected to the reset power source, before starting the application of each of the reference potentials to the first power source line and the second power source line; and starting the application of each of the reference potentials to the first power source line and the second power source line in the preset state, and setting a ready state in which a normal operation of allowing the light emitting element to emit light is able to be performed.

DETAILED DESCRIPTION OF THE INVENTION

Hereinafter, an image display device which is an embodiment of the present invention (hereinafter, referred to as an embodiment) will be described with reference to the drawings. The image display device is an active matrix type organic EL display device in which OLEDs are provided as light emitting elements.

Figure 1:
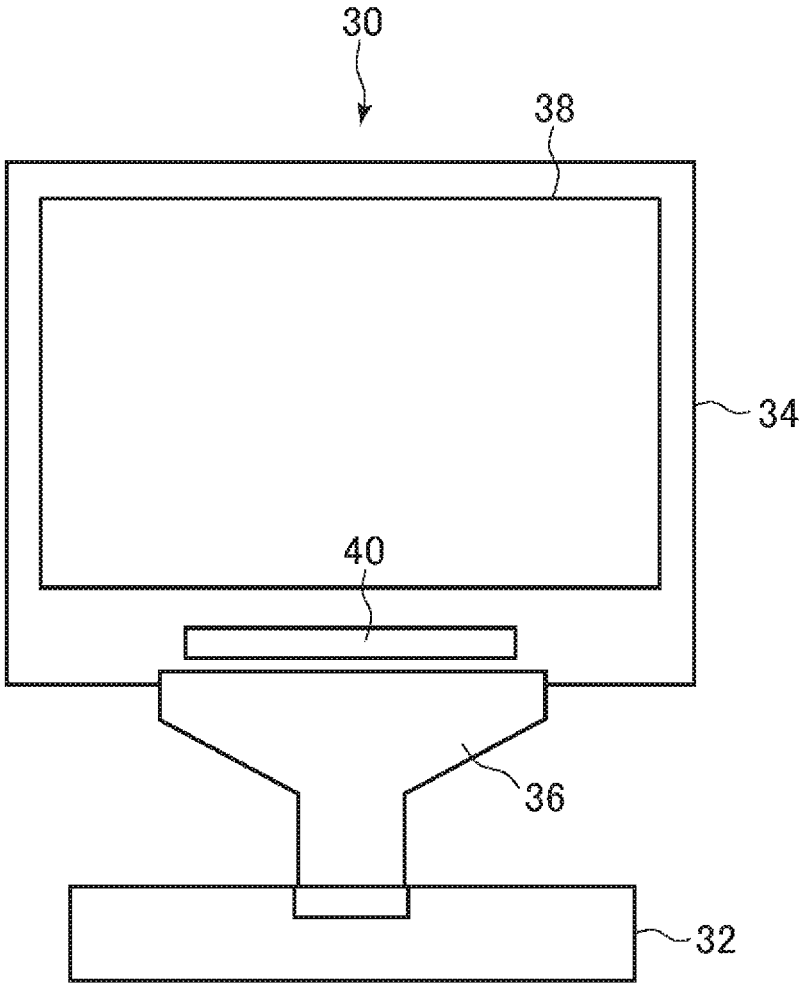
FIG. 1 is a schematic diagram illustrating a schematic configuration of an organic EL display device according to an embodiment of the present invention.

FIG. 1 is a schematic diagram illustrating a schematic configuration of an organic EL display device 30 according to the embodiment. The organic EL display device 30 includes a main body circuit 32, a display substrate 34, and a connection substrate 36. A display unit 38 in which OLEDs and pixel circuits corresponding to pixels of a display image are arranged is formed on the display substrate 34. As a control unit controlling the operation of the display unit 38, a driving circuit supplying various signals to the pixel circuit, and a controller generating a timing signal or the like which is supplied to the driving circuit are disposed. The control unit is arranged on the main body circuit 32 or the display substrate 34.

For example, a driving circuit 40 supplying signals to scanning signal lines or video signal lines of the display unit 38 is able to be arranged on the display substrate 34. The driving circuit 40 is formed by integrating the main parts thereof with one or a plurality of semiconductor chips, and by mounting the chip on the display substrate 34 or the connection substrate 36. In addition, as the driving circuit 40, a circuit configured of TFTs or the like using a semiconductor layer formed of a low temperature polysilicon is able to be directly formed on the display substrate 34. In the organic EL display device, the display substrate 34 is able to be configured of a glass substrate, a flexible material using a resin film, and the like.

In the main body circuit 32, for example, a power source circuit generating various reference potentials, a signal processing circuit processing a video signal, a frame memory, and the like are able to be arranged in addition to the control unit. The main body circuit 32, for example, is able to be formed by using a rigid substrate such as a glass epoxy substrate.

The connection substrate 36 connects the main body circuit 32 and the display substrate 34. The connection substrate 36 is able to be configured of a flexible wiring substrate. Furthermore, a part or all of the driving circuit 40 is able to be arranged on the connection substrate 36.

Figure 2:
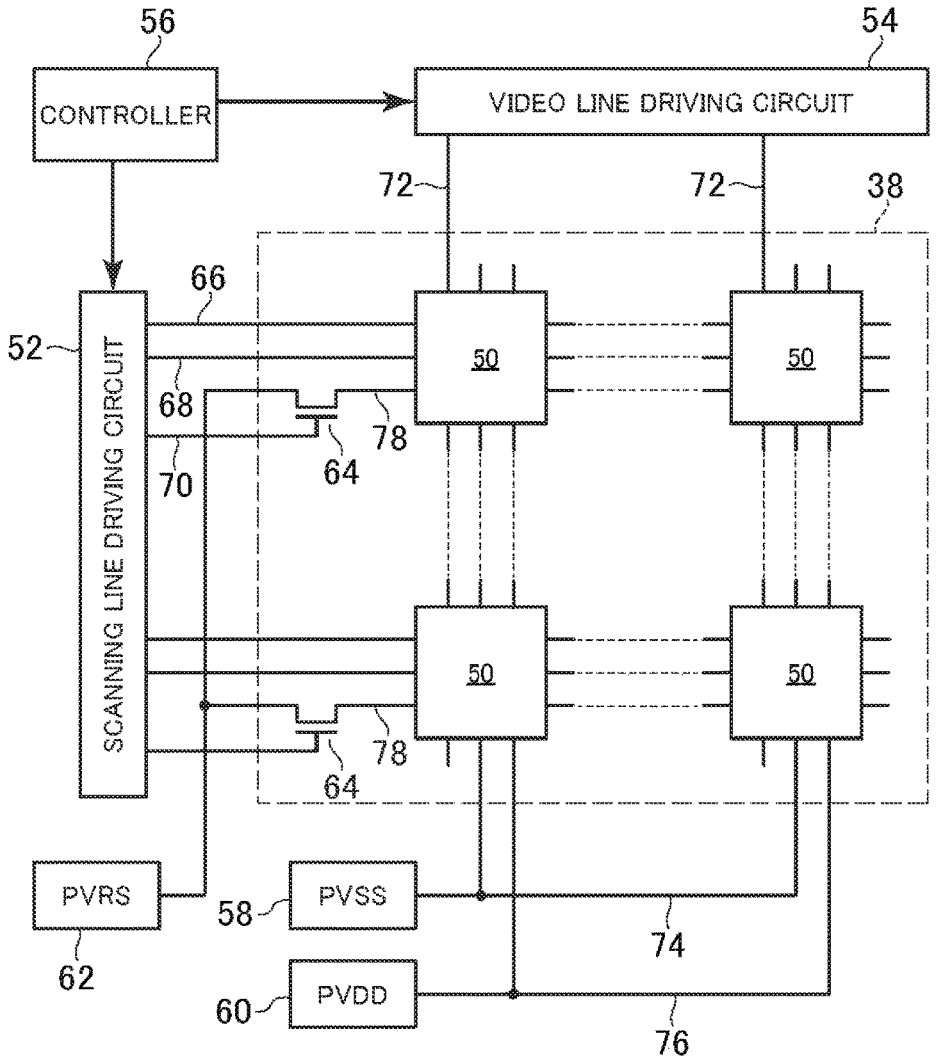
FIG. 2 is a schematic circuit diagram mainly illustrating schematic configurations of a display unit and a control unit of the organic EL display device according to the embodiment of the present invention.

FIG. 2 is a schematic circuit diagram mainly illustrating the schematic configuration of the display unit 38 and the control unit of the organic EL display device 30. Pixels 50 are arranged in the display unit 38 in the shape of a matrix.

In addition, in FIG. 2, a scanning line driving circuit 52, a video line driving circuit 54, and a controller 56 are illustrated as the control unit, and a power source circuit 58 which is a driving power source PVSS (a first power source) outputting a reference potential $V_{SS}$ (a first reference potential), a power source circuit 60 which is a driving power source PVDD (a second power source) outputting a reference potential $V_{DD}$ (a second reference potential), and a power source circuit 62 which is a reset power source PVRS outputting a reset potential $V_{RS}$ are illustrated as the power source circuit.

The scanning line driving circuit 52 outputs a control signal for each line (each pixel row) in a horizontal direction of the pixel 50 of the display unit 38. Specifically, in this embodiment, the display unit 38 includes two switches (a lighting switch and a write switch) in the pixel circuit of each of the pixels 50, and includes a reset switch 64 in each of the pixel rows. In response to this, three control signal lines (a lighting control line 66, a write control line 68, and a reset control line 70) are disposed in each of the rows of the pixel 50, and the scanning line driving circuit 52 supplies a control signal switching ON/OFF of the switch to the control lines 66, 68, and 70 of each of the rows. The scanning line driving circuit 52 includes a shift register, sequentially selects a pixel row as an operation target within the display unit 38 in a column direction (for example, a direction from an upper side to a lower side of the screen), generates a control signal with respect to the selected row, and outputs the control signal to the control lines 66, 68, and 70. In addition, the scanning line driving circuit 52 is able to collectively output the same control signal to each of the pixel rows.

Data (a pixel value) indicating a video signal of each pixel of the selected row is input into the video line driving circuit 54, and the data is converted into an analogue voltage by a D/A converter, and thus a voltage signal according to the pixel value is generated. The video line driving circuit 54 generates the voltage signal for each line (each pixel column) in a vertical direction of the pixel 50 of the display unit 38. A video signal line 72 is disposed in each of the columns of the pixel 50. The video line driving circuit 54 outputs voltage signals (video voltage signals) $V_{SIG}$ indicating the pixel values of the pixels in the selected row to the video signal line 72 of each of the column in parallel at the time of a data write operation to each of the pixels 50. In addition, the video line driving circuit 54 generates an initialization voltage signal $V_{INI}$ at the time of data initialization of the pixels 50, and outputs the initialization voltage signal $V_{INI}$ to the video signal lines 72 in parallel.

As described above, the power source circuit 58 generates the reference potential $V_{SS}$, and the reference potential $V_{SS}$ is supplied to each of the pixels 50 through a power source line 74 (a first power source line) disposed in each of the columns. As described above, the power source circuit 60 generates the reference potential $V_{DD}$, and the reference potential $V_{DD}$ is supplied to each of the pixels 50 through a power source line 76 (a second power source line) disposed in each of the columns. As described above, the power source circuit 62 generates the reset potential $V_{RS}$, and the reset potential $V_{RS}$ is supplied to each of the pixels 50 through the reset switch 64 and a reset line 78 disposed in each of the rows.

Figure 3:
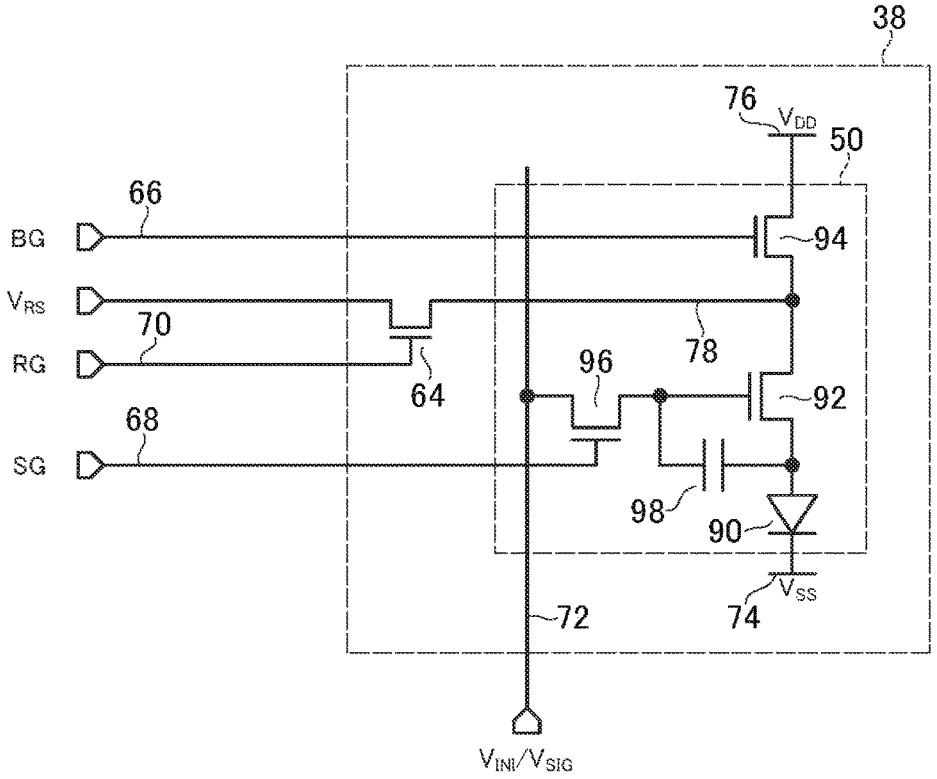
FIG. 3 is an example of a schematic equivalent circuit diagram of a pixel which is arranged in the display unit illustrated in FIG. 2.

FIG. 3 is an example of a schematic equivalent circuit diagram of the pixel 50 which is arranged in the display unit 38 illustrated in FIG. 2. Each of the pixels 50 includes an OLED 90 as the light emitting element. In this embodiment, OLED 90 includes a pixel electrode separated in each of the pixels as an anode electrode, a common electrode which is basically able to be integrally formed over the entire pixels of the display unit 38 as a cathode electrode, and an organic material layer such as a light emitting layer between the electrodes. The cathode electrode of the OLED 90 is connected to the power source line 74. In addition, the anode electrode of the OLED 90 is connected to the power source line 76 through a driving TFT 92 which is a driving transistor and a lighting switch 94 which is a first switching element. The power source line 76 is applied with a predetermined high potential as the reference potential $V_{DD}$ from the driving power source PVDD (the power source circuit 60), the power source line 74 is applied with a predetermined low potential as the reference potential $V_{Ss}$ from the driving power source PVSS (the power source circuit 58). The OLED 90 is supplied a forward current by these reference potentials $V_{DD}$ and $V_{SS}$, and thus the OLED 90 emits light. That is, the reference potential $V_{DD}$ is a potential having a potential difference with respect to the reference potential $V_{Ss}$ which allows the OLED 90 to emit the light, for example, $V_{SS}$ is able to be −2 V, and $V_{DD}$ is able to be +10 V.

In this embodiment, each of the driving TFT 92 and the lighting switch 94 is configured of an n type TFT. A source electrode which is one current terminal (a first current terminal) of two current terminals of the driving TFT 92 is connected to the anode electrode of the OLED 90, a drain electrode which is the other current terminal (a second current terminal) of the two current terminals is connected to the source electrode of the TFT which is the lighting switch 94, and a drain electrode of the lighting switch 94 is connected to the power source line 76.

In addition, a drain electrode of the driving TFT 92 is also connected to the reset power source PVRS (the power source circuit 62) through the reset switch 64 which is a second switching element. As described above, in this embodiment, the reset line 78 and the reset switch 64 are disposed for each of the pixel rows. The respective reset lines 78 extend along the pixel row, and are connected to the drain electrodes of the driving TFTs 92 of the pixel row in common. The reset switch 64, for example, is arranged on an end portion of the pixel row, and switches the connection and disconnection between the reset line 78 and the reset power source PVRS, that is, connects or blocks between the reset line 78 and the reset power source PVRS. In this embodiment, the reset switch 64 is configured of an n type TFT, as with the driving TFT 92 and the lighting switch 94.

A gate electrode which is a control terminal of the driving TFT 92 is connected to the video signal line 72 through a write switch 96, and a capacitor 98 is connected as a retentive capacitance between the gate electrode and the source electrode of the driving TFT 92. In this embodiment, the write switch 96 is configured of an n type TFT.

As described above, the lighting switch 94, the write switch 96, and the reset switch 64 are controlled ON/OFF by using the lighting control line 66, the write control line 68, and the reset control line 70 which are disposed for each pixel row. Here, the lighting control line 66 and the write control line 68 extend along the pixel row, and the lighting control line 66 and the write control line 68 are respectively connected to gate electrodes of the lighting switches 94 and gate electrodes of the write switches 96 of the pixel row in common.

Figure 4:
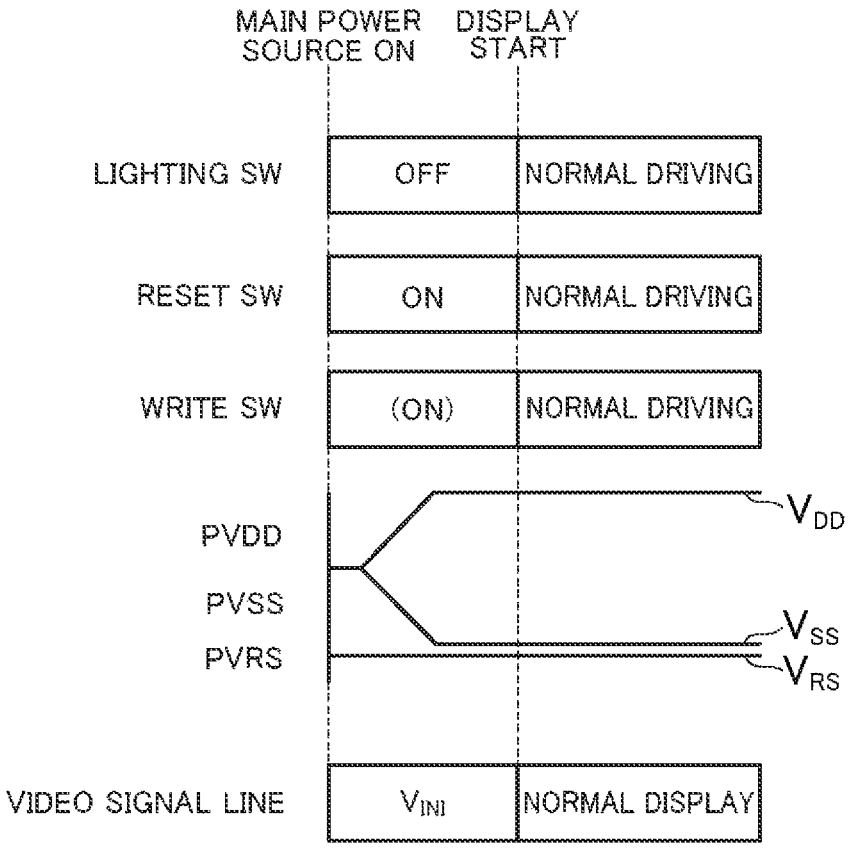
FIG. 4 is a schematic diagram illustrating a driving method of the organic EL display device according to the embodiment of the present invention.

FIG. 4 is a schematic diagram illustrating a driving method of the organic EL display device 30, and indicates an operation at the time of the main power source ON of the organic EL display device 30. In FIG. 4, Lighting SW, Reset SW, and Write SW respectively indicate the lighting switch 94, the reset switch 64, and the write switch 96. In addition, in FIG. 4, a horizontal direction corresponds to time axis, and various states relevant to the operation of the pixel are shown in a vertical direction in parallel. Specifically, as various states, the state of each of the switches 94, 64, and 96, the output voltage of each of the power source circuits 58, 60, and 62, and the signal supplied to the video signal line 72 are shown. Then, the various states from the ON timing (the power source ON) of the main power source to the start timing (Display Start) of a normal display operation are shown.

When the main power source is turned ON, the organic EL display device 30 sets the lighting switch 94 to be in an OFF state and the reset switch 64 to be in an ON state before starting up the driving power sources PVDD and PVSS, and starts up the reset power source PVRS. At this time point, the output of the driving power sources PVDD and PVSS, for example, is a ground potential (0 V).

Further, the driving TFT 92 is in the ON state at the time of the main power source ON. Specifically, the write switch 96 is in the ON state, and the initialization voltage signal $V_{INI}$ is applied to the video signal line 72, and thus the driving TFT 92 is in a conductive state. Accordingly, the anode electrode of the OLED 90 is connected to the reset power source PVRS. Hereinafter, this state will be referred to as a preset state. In the preset state, the anode potential of the OLED 90 is basically fixed to a potential according to the reset potential $V_{RS}$.

Figure 9:
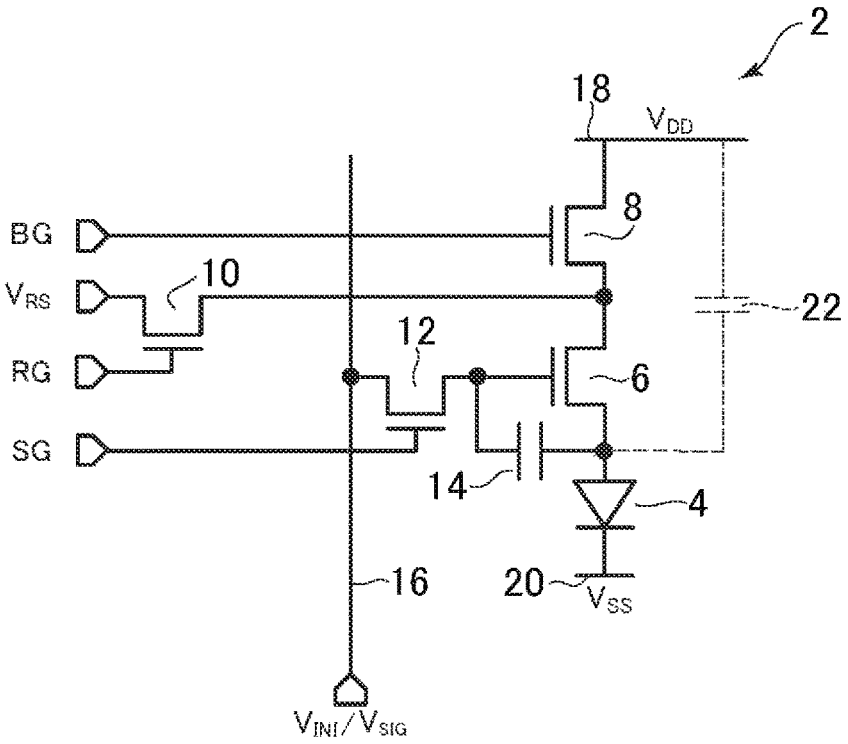
FIG. 9 is a schematic circuit diagram of a pixel circuit which is arranged in a display unit of an organic EL display panel of the conventional art.

The organic EL display device 30 starts the application of the reference potential $V_{Ss}$ from the driving power source PVSS to the power source line 74 and the application of the reference potential $V_{DD}$ from the driving power source PVDD to the power source line 76 in the preset state, and sets a ready state in which a normal operation allowing the OLED 90 to emit the light is able to be performed. At this time, as described above, the anode potential of the OLED 90 is fixed to the potential $V_{RS}$. Accordingly, the anode potential of the OLED 90, for example, is not affected by coupling with respect to a portion in which the potential is changed according to the start-up of the driving power source such as coupling due to parasitic capacitance (capacitance 22 illustrated in FIG. 9) with respect to the power source line 76. In the ready state, the voltage applied to the OLED 90 is ($V_{RS}$–$V_{SS}$), and the reset potential $V_{RS}$ is set such that the voltage ($V_{RS}$–$V_{SS}$) is less than or equal to a light emission threshold value voltage (light emission starting voltage) of the OLED 90. Accordingly, the flash phenomenon at the time of the main power source ON is suppressed and prevented. Incidentally, the light emission threshold value voltage is a voltage at which a current begins to flow through the OLED 90, that is, a forward voltage drop $V_F$. For example, the reset potential $V_{RS}$ is able to be −2 V which is identical to the reference potential $V_{SS}$.

Figure 5:
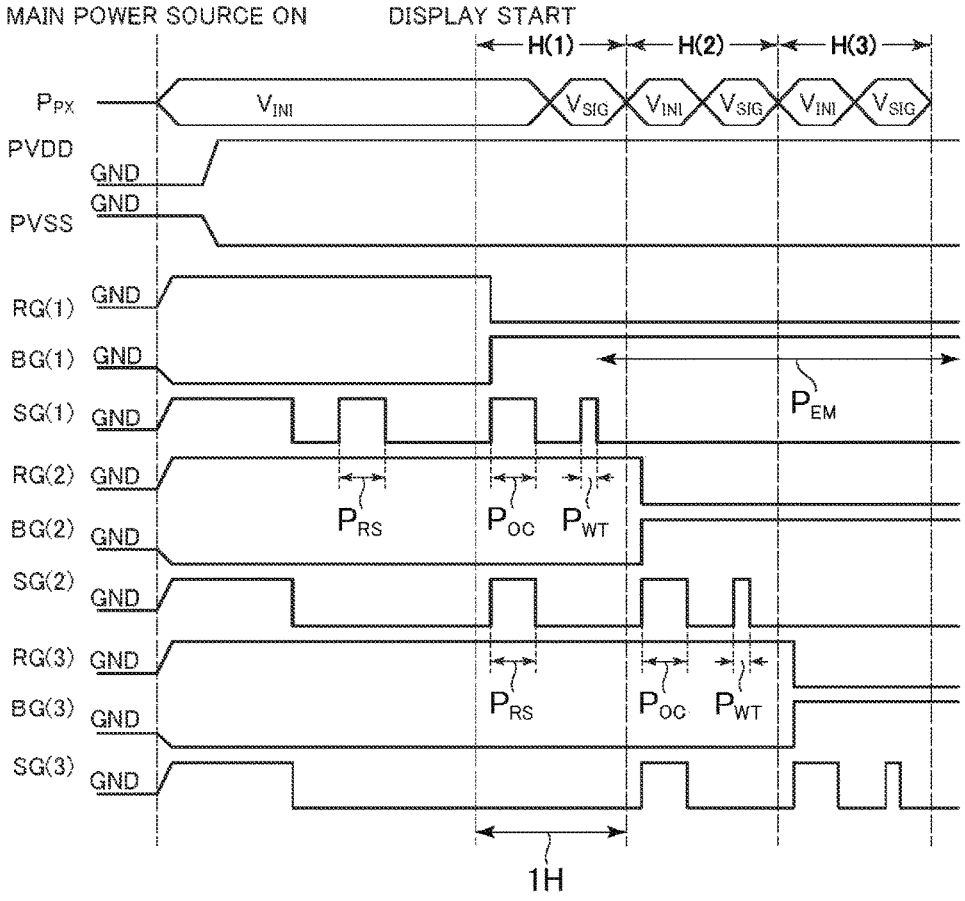
FIG. 5 is a schematic timing chart illustrating the driving method of the organic EL display device according to the embodiment of the present invention.

FIG. 5 is a schematic timing chart illustrating the driving method of the organic EL display device 30, and in FIG. 5, a change in various signals from the main power source ON to the start of the display operation is illustrated. In FIG. 5, a horizontal axis is a time axis, and a right direction is a time passage direction. As the various signals, a video line signal $V_{PX}$ supplied from the video line driving circuit 54 to the video signal line 72, the output of the driving power sources PVDD and PVSS, and control signals RG, BG, and SG with respect to each of the reset switch 64, the lighting switch 94, and the write switch 96 are exemplified. As an example of the control signals RG, BG, and SG, signals with respect to the first pixel row to the third pixel row are exemplified, and RG(m), BG(m), and SG(m) indicate signals with respect to the m-th row. After the main power source ON, the scanning line driving circuit 52 sets each of the control signals to either a Low level (hereinafter, an L level) which is a predetermined low potential or a High level (hereinafter, an H level) which is a predetermined high potential. Here, the reset switch 64, the lighting switch 94, and the write switch 96 which are formed of the n type TFT are turned ON at the H level, and are turned OFF at the L level.

The display operation of the organic EL display device 30 is performed by a raster scan. In this embodiment, when the main power source is turned ON, as described above, the ready state is set, and then as the display operation, the operation in which a plurality of pixel rows configuring the display unit 38 are sequentially selected from the first row, the video voltage signals $V_{SIG}$ are written in the pixels of the selected row to allow the OLEDs 90 to emit the light is repeated for each image of one frame. Specifically, the write operation in this embodiment is divided into a reset operation, an offset cancel operation, and a write and mobility correction operation.

A reset period $P_{RS}$, an offset cancel period $P_{OC}$, and a write and mobility correction period $P_{WT}$ in FIG. 5 are periods corresponding to the reset operation, the offset cancel operation, and the write and mobility correction operation. Hereinafter, each of the operations in the m-th row which is an arbitrary pixel row will be described.

The reset operation is an operation which resets the voltage retained in the capacitor 98, and thus data written in the pixel according to the video signal in the previous frame is initialized. Specifically, in the reset operation, the control signal BG(m) is set to the L level, and thus the lighting switch 94 is turned OFF, the control signal RG(m) is set to the H level, and thus the reset switch 64 is turned ON, and in a state where the initialization voltage signal $V_{INI}$ is applied to each of the video signal lines 72, the control signal SG(m) is set to the H level, and thus the write switch 96 is turned ON. Accordingly, the gate potential of the driving TFT 92 is reset to a potential corresponding to $V_{INI}$, and the driving TFT 92 is set to be in the conductive state, and thus the source potential of the driving TFT 92 is reset to a potential corresponding to $V_{RS}$, and a voltage between terminals of the capacitor 98 of each of the pixels 50 is set to a voltage corresponding to ($V_{INI}$–$V_{RS}$). Incidentally, the control of the pixel circuit in this reset operation is identical to the control of the preset operation described above. Furthermore, the initialization voltage signal $V_{INI}$, for example, is able to be set to 1 V.

The offset cancel operation is an operation of compensating a variation in threshold value voltages $V_{th}$ of the driving TFTs 92. Specifically, in the offset cancel operation, the control signal RG(m) is set to the L level, and thus the reset switch 64 is turned OFF, the control signals SG(m) and BG(m) are set to the H level, and thus the write switch 96 and the lighting switch 94 are turned ON, and the initialization voltage signal $V_{INI}$ is applied to each of the video signal lines 72. The gate potential of the driving TFT 92 is fixed to a potential corresponding to $V_{INI}$. In addition, the lighting switch 94 is in the ON state, and thus a current flows from the driving power source PVDD into the driving TFT 92, and the source potential of the driving TFT 92 increases from the potential $V_{RS}$ which is written in the reset period $P_{RS}$. Then, when the source potential reaches a potential ($V_{INI}$–$V_{th}$) which is $V_{th}$ less than the gate potential, the driving TFT 92 becomes in a non-conductive state, the source potential is fixed to ($V_{INI}$–$V_{th}$), and the voltage between the terminals of the capacitor 98 is set to a voltage corresponding to $V_{th}$. By using this state as a reference, a voltage corresponding to $V_{SIG}$ is written in the capacitor 98 in the write and mobility correction operation, and thus the influence of the variation of $V_{th}$ between the pixels is removed from a current flowing through the driving TFT 92 in the light emitting operation.

In the write and mobility correction operation, the video voltage signal $V_{SIG}$ is written in the pixel, and the mobility of the driving TFT 92 is compensated. In the write operation, the capacitor 98 is charged according to $V_{SIG}$. In this embodiment, as a mobility correction method, a method is adopted in which the compensation of the mobility is also performed in a charging step of the capacitor 98.

In the write and mobility correction period $P_{WT}$, the control signal RG(m) is maintained to the L level and the control signal BG(m) is maintained to the H level continuously from the offset cancel period $P_{OC}$. After the offset cancel operation ends, the write switch 96 is once turned OFF, and the voltage signal $V_{SIG}$ is supplied to each of the video signal lines 72. In this state, the control signal SG(m) is set to the H level, and thus the write switch 96 is turned ON, and accordingly, the gate potential of the driving TFT 92 increases to a potential corresponding to $V_{SIG}$ from a potential corresponding to $V_{INI}$. At this time, the driving TFT 92 is in the conductive state, and the source potential also increases in association with the gate potential. When the capacitance of the capacitor 98 is represented by $C_s$ and the parasitic capacitance of the OLED 90 is represented by $C_{el}$, a ratio of a change in the source potential to a change in the gate potential corresponds to a capacitance coupling ratio $C_s/(C_s+C_{el})$. The change in the source potential is stopped at a suitable timing in mid-flow by controlling the write switch 96, and thus the source potential is able to be set such that the influence of a variation in the mobility is suppressed.

When the write switch 96 is turned OFF, and thus the write and mobility correction operation ends, a light emitting period $P_{EM}$ starts, and the OLED 90 emits light at intensity corresponding to $V_{SIG}$. That is, the driving TFT 92 which is in the conductive state in the write and mobility correction operation is maintained to be in the conductive state due to the voltage retained in the capacitor 98 even when the write switch 96 is turned OFF, and controls an amount of a driving current corresponding to the voltage signal $V_{SIG}$. The driving current is supplied to the OLED 90, and thus the OLED 90 emits the light at brightness corresponding to $V_{SIG}$.

The light emission of the OLED 90 in the m-the row is able to be continued by turning the lighting switch 94 ON during an arbitrary period until the write operation of the image of the next frame in the m-th row starts. At the time of the reset operation in the write operation of the next frame, when the light emission once stops, and a video signal of a new frame is written in the pixel of the m-th row, the light emission of the OLED 90 starts again.

As described above, the operation of the m-th row is described. As described above, the main power source is turned ON, and thus the display operation starts, and then in each of the pixel rows, the write operation (the reset operation, the offset cancel operation, and the write and mobility correction operation) and the light emitting operation are repeated in one frame cycle.

The write operation and the light emitting operation are sequentially performed for each of the pixel rows, and the pixel rows, for example, are sequentially selected with a period of one horizontal scanning period (1H) of the video signal. In the operation illustrated in FIG. 5, the video line driving circuit 54 provides a period (a $V_{INI}$ period) of applying $V_{INI}$ to the video signal line 72 and a period (a $V_{SIG}$ period) of applying $V_{SIG}$ to the video signal line 72 for each of the horizontal scanning periods after the display start, and for example, in the $V_{SIG}$ period of the k-th horizontal scanning period H(k), $V_{SIG}$ corresponding to the k-th row is output. Then, the write and mobility correction period $P_{WT}$ of the m-th row is able to be set within the $V_{SIG}$ period in H(m), the offset cancel period $P_{OC}$ is able to be set within the most recent $V_{INI}$ period, and the reset period $P_{RS}$ is able to be set within the $V_{INI}$ period before 1H.

Here, the scanning line driving circuit 52 sets the control signal BG(m) to the L level and the control signal RG(m) to the H level with respect to all of the pixel rows in order to realize the preset state before the main power source ON. The scanning line driving circuit 52 continues the state of BG(m) and RG(m) until the offset cancel period $P_{OC}$ of each of the pixel rows starts. That is, after the main power source is turned ON, and thus the ready state is set, and even after the display start, the lighting switch 94 is turned OFF, and the reset switch 64 is turned ON until the offset cancel period $P_{OC}$ of each of the pixel rows starts, and thus the anode of the OLED 90 of the pixel row is fixed to a potential corresponding to the reset potential $V_{RS}$. Accordingly, the occurrence of the flash phenomenon due to the light emission of the OLED 90 is prevented before the $V_{SIG}$ of an initial frame is written in the OLED 90.

Incidentally, one of causes of the occurrence of the flash phenomenon is that in the case where the lighting switch 94 is turned ON and the driving TFT 92 is in the conductive state after the driving power sources PVDD and PVSS start up and thus the ready state is set, a driving current flows through the OLED 90. That is, at the time of setting the preset state, the driving TFT 92 is applied $V_{INI}$ to its gate and thus set to the conductive state, and this state is maintained by the capacitor 98 even when the write switch 96 is turned OFF so as to isolate the gate of the driving TFT 92 from the video signal line 72. In this state, when the lighting switch 94 is turned ON, the OLED 90 emits the light. This is different in an occurrence mechanism from the flash phenomenon described above which is prevented by setting the preset state, that is, the flash phenomenon which occurs due to capacitance coupling at the time of the main power source ON even when the lighting switch 94 is in the OFF state, but is identical to the flash phenomenon described above in that it is unintended light emission and not preferable.

In this embodiment, as described above, since the lighting switch 94 is maintained to be in the OFF state until the offset cancel period $P_{OC}$ of each of the pixel rows starts, the flash phenomenon due to the cause of the occurrence is able to be prevented. Further, the reset switch 64 is maintained to be ON until the period $P_{OC}$ starts, and thus as with the preset state, the anode of the OLED 90 is fixed to a potential corresponding to $V_{RS}$, and accordingly, even when the reference potential $V_{DD}$ is changed due to any cause, the light emission of the OLED 90 due to the anode potential of the OLED 90 being changed by the capacitance coupling is able to be prevented, and the flash phenomenon is able to be preferably prevented.

Figure 6:
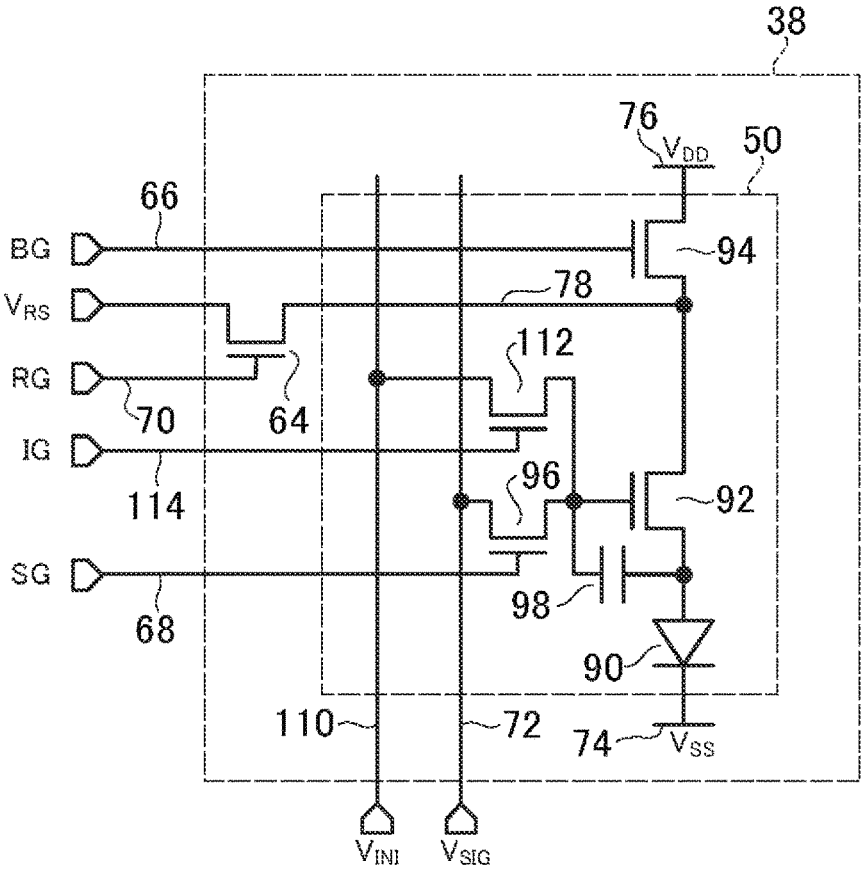
FIG. 6 is a schematic equivalent circuit diagram of another configuration example of the pixel which is arranged in the display unit illustrated in FIG. 2.
Figure 7:
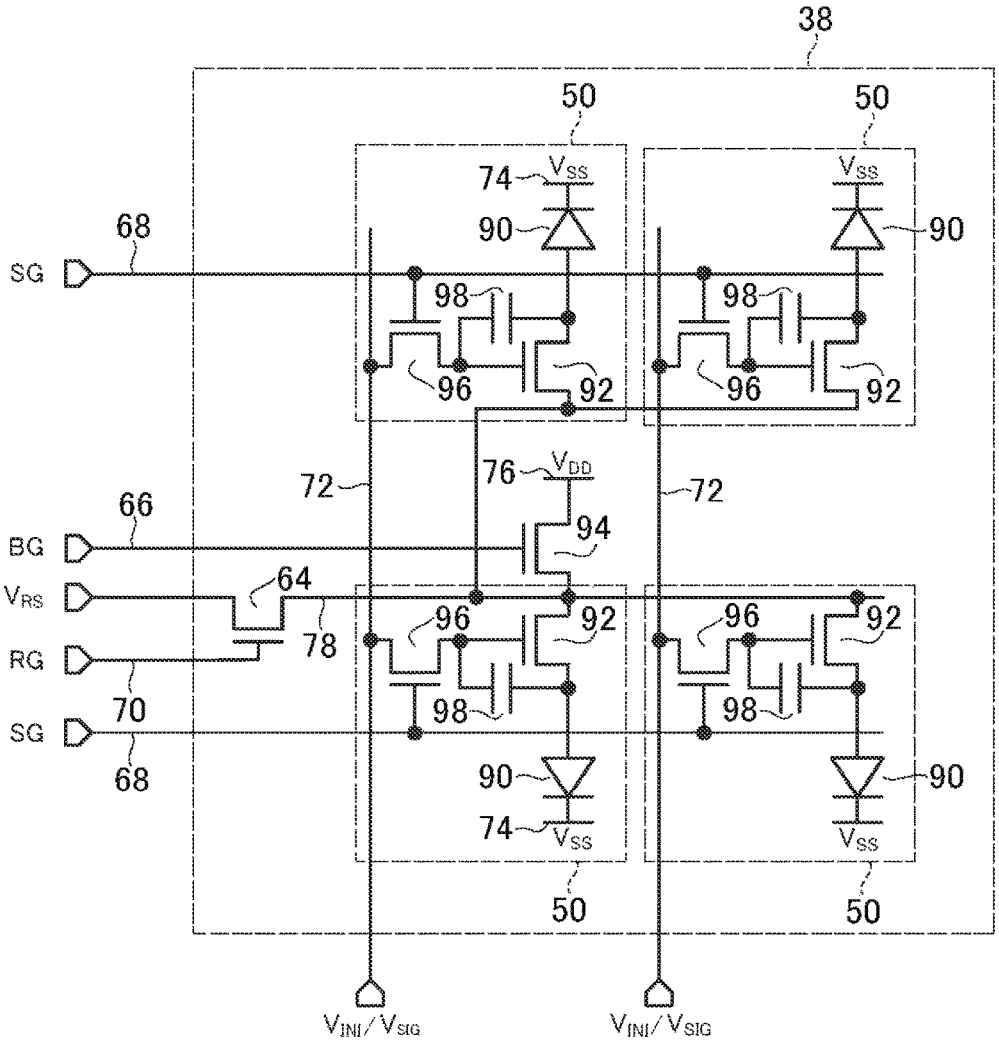
FIG. 7 is a schematic equivalent circuit diagram of another configuration example of the pixel which is arranged in the display unit illustrated in FIG. 2.
Figure 8:
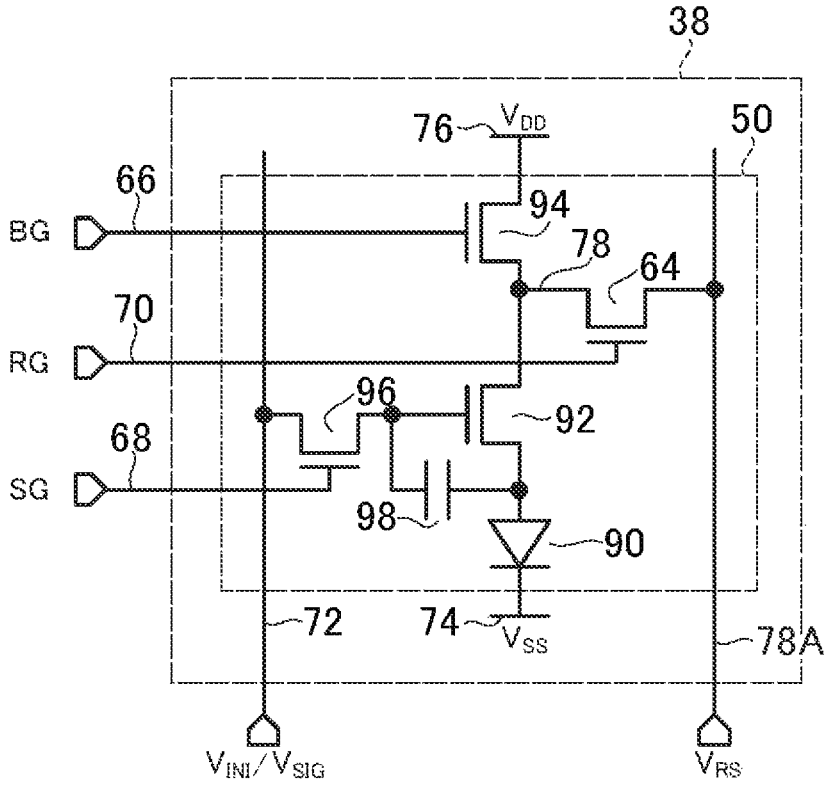
FIG. 8 is a schematic equivalent circuit diagram of another configuration example of the pixel which is arranged in the display unit illustrated in FIG. 2.

The present invention described with reference to the embodiment described above is also able to be applied to a pixel circuit having a configuration other than the configuration illustrated in FIG. 3. FIG. 6 to FIG. 8 are schematic equivalent circuit diagrams of the pixel 50 including a pixel circuit having another configuration, and the present invention is also able to be applied to an organic EL display device including these pixels. Hereinafter, the same reference numerals are applied to configurations having the same functions as those of the configuration described above, the description thereof will be omitted, and differences from the configurations described above will be mainly described.

The pixel circuit illustrated in FIG. 6 is different from the pixel circuit illustrated in FIG. 3 in that the video voltage signal $V_{SIG}$ and the initialization voltage signal $V_{INI}$ are supplied in different systems. Specifically, an initialization signal line 110 is provided in each of the pixel columns separately from the video signal line 72 and an initialization switch 112 is provided in each of the pixels 50. The initialization switch 112 is able to be configured of a TFT as with other switches, and switches the connection/disconnection between the gate electrode of the driving TFT 92 and the initialization signal line 110 according to a control signal IG from the scanning line driving circuit 52. An initialization control line 114 supplying the control signal IG is provided in each of the pixel rows, and controls the initialization switches 112 of each of the pixel rows in common. The initialization signal line 110 is applied with $V_{INI}$, and in a period during which $V_{INI}$ is applied to the pixel 50 in the operation described above in the circuit of FIG. 6, the write switch 96 is turned OFF and the initialization switch 112 is turned ON. Only $V_{SIG}$ is able to be supplied to the video signal line 72 by being switched for each 1H. In a period during which $V_{SIG}$ is applied to the pixel 50 in the operation described above in the circuit of FIG. 6, the initialization switch 112 is turned OFF and the write switch 96 is turned ON.

The pixel circuit illustrated in FIG. 7 is different from the pixel circuit illustrated in FIG. 3 in that the lighting switch 94 and the reset switch 64 are common in a plurality of pixel rows. Pixels of two row and two columns are illustrated in FIG. 7, and the connection/disconnection between these pixels and the driving power source PVDD is able to be switched by one lighting switch 94. In addition, the connection/disconnection between the two pixel rows and the reset power source PVRS is able to be switched by one reset switch 64.

In this configuration, the reset operations of the adjacent two rows are concurrently performed, and after the reset operation, the operations of the two rows which set the reset switch 64 to be in the OFF state and the lighting switch 94 to be in the ON state are also concurrently performed. On the other hand, the write and mobility correction operations of the two rows are separately performed by being shifted by 1H.

The offset cancel operations of the two rows are basically concurrently performed. As described in the embodiment, all of the pixel rows of the display unit 38 are in the preset state at the time of the main power source ON in which the lighting switch 94 is in the OFF state and the reset switch 64 is in the ON state. This preset state is continued until the offset cancel operations of the two rows sharing the lighting switch 94 and the reset switch 64 start, and thus the flash phenomenon is able to be suppressed.

Furthermore, the offset cancel operations of the two rows are able to be performed by delaying one row by 1H. In this case, the preset states of the two rows concurrently end at a timing of starting the offset cancel operation which is performed first, and the driving TFT 92 of the pixel row of which the offset cancel operation is performed later is in the conductive state for a period of approximately 1H from the end of the preset state to the start of the offset cancel operation. Accordingly, as described above, a method in which the offset cancel operations of the two pixel rows concurrently start so that the driving TFTs 92 of the two rows concurrently reach the non-conductive state has a high suppression effect of the flash phenomenon.

The lighting switch 94 and the reset switch 64 are able to be configured to be shared by three or more pixels. In addition, the number of pixel columns sharing the lighting switch 94 is able to be greater than or equal to 3.

The pixel circuit illustrated in FIG. 8 is different from the pixel circuit illustrated in FIG. 3 in that the reset switch 64 is disposed in each of the pixels 50. Specifically, the reset line 78A connected to the reset power source PVRS is wired along each of the pixel columns, and the reset control line 70 is wired along each of the pixel rows. The reset switch 64 of each of the pixels 50 is connected between the reset line 78A of the pixel column where the pixel belongs to and the drain of the driving TFT 92, and ON/OFF of the reset switch 64 is controlled by the reset control line 70 of the pixel row where the pixel belongs to.

The modifications with respect to the pixel 50 illustrated in FIG. 3 which are described with reference to FIG. 6 to FIG. 8 are combined with each other, and thus are able to be applied to the pixel 50. Further, according to a pixel circuit which is able to start up the driving power sources PVDD and PVSS while applying a constant potential to the anode of the OLED 90, the flash phenomenon is able to be suppressed by using the driving method described above.

In the embodiment described above, the driving TFT 92 is the n-channel type transistor, and is able to be a p-channel type transistor. In addition, the lighting switch 94, the reset switch 64, and the write switch 96 are able to be p-channel type transistors instead of the n-channel type transistors.

In addition, the polarity of the diode of the OLED 90 is able to be opposite to that illustrated in FIG. 3. In this case, the reference potential $V_{DD}$ which is supplied from the driving power source PVDD to the power source line 76 is lower than the reference potential $V_{SS}$ which is supplied from the driving power source PVSS to the power source line 74 such that a forward current is supplied to the OLED 90 at the time of the light emitting operation. The reset potential $V_{RS}$ is set such that the voltage ($V_{SS}-V_{RS}$) applied to the OLED 90 in the ready state is less than or equal to the light emission threshold value voltage (the forward voltage drop $V_F$) of the OLED 90.

For example, the pixel 50 is able to be configured such that the direction of the OLED 90 is opposite to that illustrated in FIG. 3, the second reference potential $V_{DD}$ is higher than the first reference potential $V_{SS}$, and the driving TFT 92 is a p type TFT.

According to the present invention described with reference to the embodiment described above, the flash phenomenon at the time of the power source ON of the display device is able to be prevented or suppressed.

In the embodiment described above, the organic EL display device is exemplified as a disclosure example of the display device, and the present invention is also able to be applied to other self-light emitting display devices including a pixel circuit in which the flash phenomenon occurs at the time of the main power source ON.

In the category of the idea of the present invention, a person skilled in the art is able to conceive various modification examples and correction examples, and it is understood that these modification examples and correction examples belong to the range of the present invention. For example, the addition or the deletion of constituents, or design changes, or the addition or omission of operations, or condition changes which are suitably performed with respect to the embodiment described above by a person skilled in the art are included in the range of the present invention unless deviated from the gist of the present invention.

In addition, it is understood that in other functional effects which are able to be obtained by the aspects described in this embodiment, functional effects which are obvious from the description in this specification or functional effects which are suitably conceived by a person skilled in the art are able to be obtained by the present invention.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A display device, comprising:

a light emitting element emitting light by applying a voltage between electrodes;

a first power source line applied with a first reference potential which is supplied to one electrode of the light emitting element;

a second power source line applied with a second reference potential which allows the light emitting element to emit light;

a driving transistor controlling an amount of current between a first current terminal which is connected to the other electrode of the light emitting element and a second current terminal which is connected to the second power source line according to a control voltage signal;

a first switching element switching connection and disconnection between the second power source line and the second current terminal;

a second switching element switching the presence or absence of application of a reset potential to the second current terminal from a reset power source; and a control unit executing a power source ON sequence, wherein the driving transistor is an n-channel type transistor, the second reference potential is higher than the first reference potential, the reset potential has a potential difference which is less than a light emission starting voltage of the light emitting element to the first reference potential, and the power source ON sequence controls the first switching element so as to block between the driving transistor and the second power source line, and controls the second switching element and the driving transistor so as to set a preset state in which the other electrode of the light emitting element is connected to the reset power source, before starting the application of each of the reference potentials to the first power source line and the second power source line, and starts the application of each of the reference potentials to the first power source line and the second power source line in the preset state, thereby setting a ready state in which a normal operation of allowing the light emitting element to emit light is able to be performed.

2. The display device according to claim 1, wherein the first switching element is configured as a transistor having the same polarity as that of the driving transistor, and the second switching element are configured as another transistor having the same polarity as that of the driving transistor.

3. A display device, comprising:

a light emitting element disposed in each of a plurality of pixels which are arranged in a plurality of rows and emitting light by applying a voltage between electrodes;

a first power source line applied with a first reference potential which is supplied to one electrode of the light emitting element;

a second power source line applied with a second reference potential which allows the light emitting element to emit light;

a driving transistor disposed in each of the pixels and controlling an amount of current between a first current terminal which is connected to the other electrode of the light emitting element of the pixel and a second current terminal which is connected to the second power source line according to a control voltage signal;

at least one first switching element switching connection and disconnection between the second power source line and the second current terminal of a plurality of the driving transistors which are arranged in each of pixel rows;

at least one second switching element switching the presence or absence of application of a reset potential from a reset power source to the second current terminal of a plurality of the driving transistors which are arranged in each of the pixel rows; and a control unit executing a power source ON sequence, wherein:

the driving transistor is an n-channel type transistor, the second reference potential is higher than the first reference potential, the reset potential has a potential difference which is less than a light emission starting voltage of the light emitting element to the first reference potential, and the power source ON sequence controls the first switching element so as to block between the driving transistor and the second power source line, and controls the second switching element and the driving transistor so as to set a preset state in which the other electrode of the light emitting element is connected to the reset power source, before starting the application of each of the reference potentials to the first power source line and the second power source line, in each of the pixel rows, starts the application of each of the reference potentials to the first power source line and the second power source line in the preset state, and then sequentially controls the second switching element for each of the pixel rows in synchronization with a raster scan so as to stop the supply of the reset potential to the other electrode of the light emitting element, and performs an operation of allowing the light emitting element of the pixel row to emit light.

4. The display device according to claim 3, wherein the first switching element is configured as a transistor having the same polarity as that of the driving transistor, and the second switching element are configured as another transistor having the same polarity as that of the driving transistor.

5. A driving method of a display device which includes a light emitting element emitting light by applying a voltage between electrodes, a first power source line applied with a first reference potential which is supplied to one electrode of the light emitting element, a second power source line applied with a second reference potential which allows the light emitting element to emit light, a driving transistor controlling an amount of current between a first current terminal which is connected to the other electrode of the light emitting element and a second current terminal which is connected to the second power source line according to a control voltage signal, a first switching element switching connection and disconnection between the second power source line and the second current terminal, and a second switching element switching the presence or absence of application of a reset potential to the second current terminal from a reset power source, wherein:

the driving transistor is an n-channel type transistor;

the second reference potential is higher than the first reference potential; and the reset potential has a potential difference which is less than a light emission starting voltage of the light emitting element to the first reference potential, the method comprising:

controlling the first switching element so as to block between the driving transistor and the second power source line, and controlling the second switching element and the driving transistor so as to set a preset state in which the other electrode of the light emitting element is connected to the reset power source, before starting the application of each of the reference potentials to the first power source line and the second power source line; and starting the application of each of the reference potentials to the first power source line and the second power source line in the preset state, and setting a ready state in which a normal operation of allowing the light emitting element to emit light is able to be performed.

* * * * *